US006132345A

United States Patent [19]

Beierschmitt et al.

[11] Patent Number: 6,132,345

[45] Date of Patent: Oct. 17, 2000

[54] LIGHTED WEIGHT

[76] Inventors: Karen Torpey Beierschmitt; Christine M. Torpey, both of 55 Monteview Dr. 764-4720, York, Pa. 17404; Richard E. Plowman, 6199 Lake Rd., York, Pa. 17403

[21] Appl. No.: 09/406,812

[22] Filed: Sep. 28, 1999

Related U.S. Application Data

[60] Provisional application No. 60/102,086, Sep. 29, 1998.

[51] Int. Cl.[7] ..... A63B 21/075

[52] U.S. Cl. ..... 482/108; 482/74; 362/84

[58] Field of Search ..... 482/1, 74, 93, 482/106–109; D21/680–681; 362/84

[56] References Cited

U.S. PATENT DOCUMENTS

| | | | |
|---|---|---|---|
| 2,259,416 | 10/1941 | Gardner | 362/84 |
| 5,428,514 | 6/1995 | Fink | 482/108 |
| 5,893,629 | 4/1999 | Gubernick | 362/84 |

*Primary Examiner*—John Mulcahy
*Attorney, Agent, or Firm*—Aquilino, Welsh & Flaxman

[57] ABSTRACT

An exercise dumbbell includes a handle having a first weight member releasably coupled thereto. In addition, a first light structure is releasably coupled to the handle adjacent the first weight member such that the light member securely couples the weight member to the handle. The first light structure includes a light source house within a fluorescent lens.

12 Claims, 6 Drawing Sheets

LIGHTED WEIGHT

CROSS-REFERENCE TO RELATED APPLICATIONS

This U.S. patent application is based upon U.S. Provisional Patent Application Ser. No. 60/102,086, filed Sep. 29, 1998, entitled "LIGHTED WEIGHT".

BACKGROUND OF THE INVENTION

1. Field of the Invention

The invention relates to exercise devices. More particularly, the invention relates to an exercise dumbbell including a lighting structure.

2. Description of the Prior Art

Dumbbells offer individuals a highly versatile exercise device at a minimal cost. Dumbbells are used, and stored, at home by individuals wishing to exercise within the privacy of their own home. They are also used by those people working out at a gym or health club. In addition, dumbbells are used as a means of applying resistance to an individual's upper body while he or she walks or runs.

In view of the versatility offered by dumbbells, people are consistently attempting to improve dumbbells. As such, people have attempted to improve upon the basic dumbbell by providing new grips, adjustment features and other mechanisms designed to improve the overall function of the dumbbells.

Prior designers have, however, overlooked the need for making the use of dumbbells safer and more fun. Specifically, and particularly with regard to those individuals using dumbbells while they walk or run, it is often difficult to see runners at night, and at times it is even difficult to see runners during the day.

The present invention provides a dumbbell encouraging enhanced safety, as well as fun.

SUMMARY OF THE INVENTION

It is, therefore, an object of the present invention to provide an exercise dumbbell including a handle having a first weight member releasably coupled thereto. In addition, a first light structure is releasably coupled to the handle adjacent the first weight member such that the light member securely couples the weight member to the handle.

It is also an object of the present invention to provide an exercise dumbbell wherein the handle includes a first end and a second end, and the first weight member and the first light structure are attached at the first end of the handle.

It is another object of the present invention to provide an exercise dumbbell wherein the handle includes a first annular ring positioned adjacent the first end of the handle and the first weight member is releasably secured between the first annular ring and the first light structure.

It is a further object of the present invention to provide an exercise dumbbell wherein the first light member includes a light source housed within a lens, and the first weight member is releasably secured between the first annular ring and the lens.

It is also an object of the present invention to provide an exercise dumbbell further including a second weight member and second light structure respectively releasably coupled to the second end of the handle, wherein the second light member securely couples the second weight member to the second end of the handle.

It is still another object of the present invention to provide an exercise dumbbell wherein the light source is a light emitting diode.

It is a further object of the present invention to provide an exercise dumbbell wherein the lens is a fluorescent lens.

It is also another object of the present invention to provide an exercise dumbbell wherein the fluorescent lens is manufactured from phosphorescent polycarbon plastic.

It is still another object of the present invention to provide an exercise dumbbell including a battery housed within the handle for powering the first light structure.

It is a further object of the present invention to provide an exercise dumbbell including means for selectively powering the first light member.

It is also an object of the present invention to provide an exercise dumbbell wherein the means for selectively powering includes spring biased electrical contacts which selectively complete the circuit between the battery and the first light structure.

It is another object of the present invention to provide an exercise dumbbell including a handle having a first weight member coupled thereto and a first light structure coupled to the handle, wherein the first light structure includes a light source housed within a fluorescent lens.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
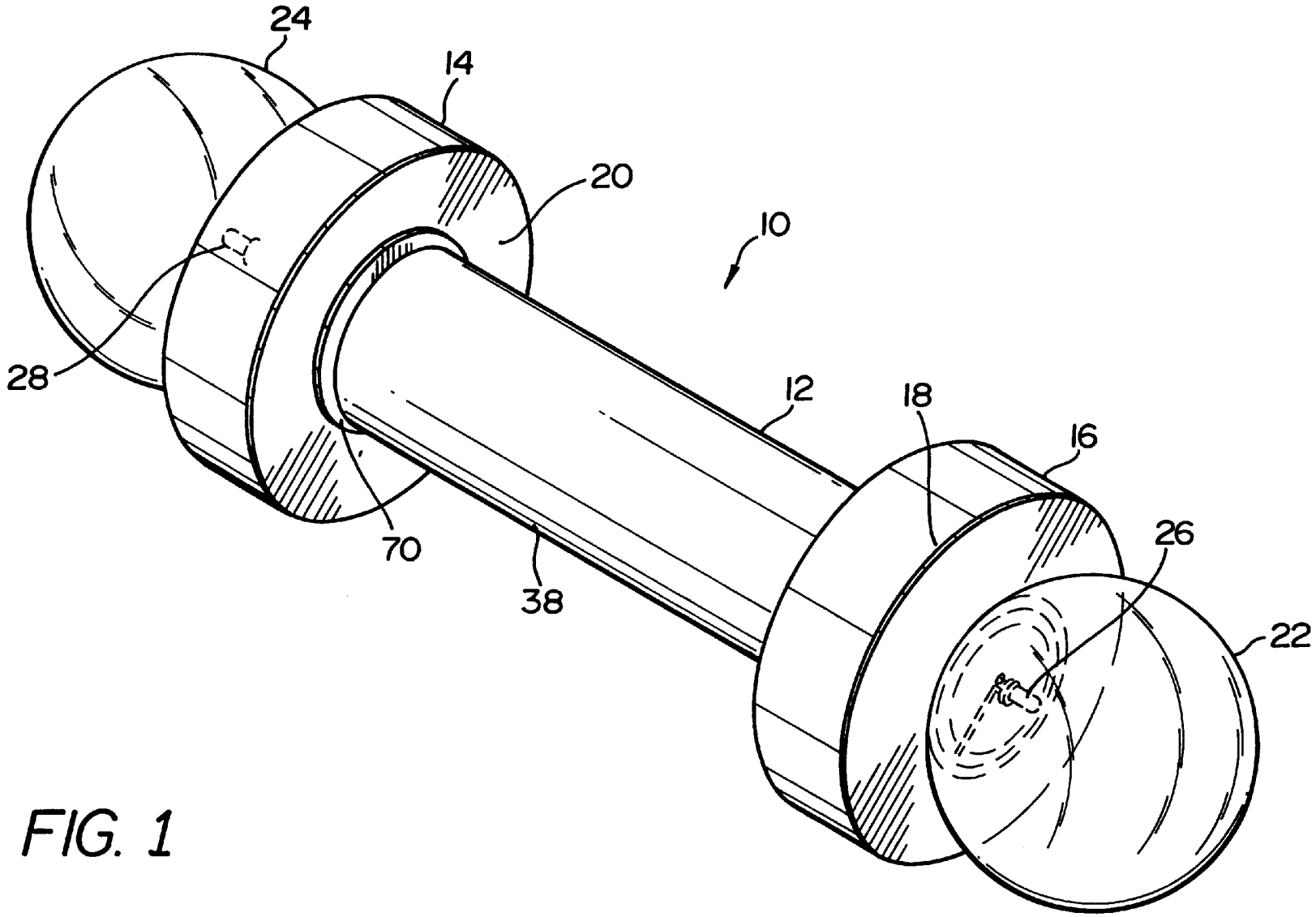
FIG. 1 is a perspective view of the present dumbbell showing structure found within the first spherical lens.
Figure 2:
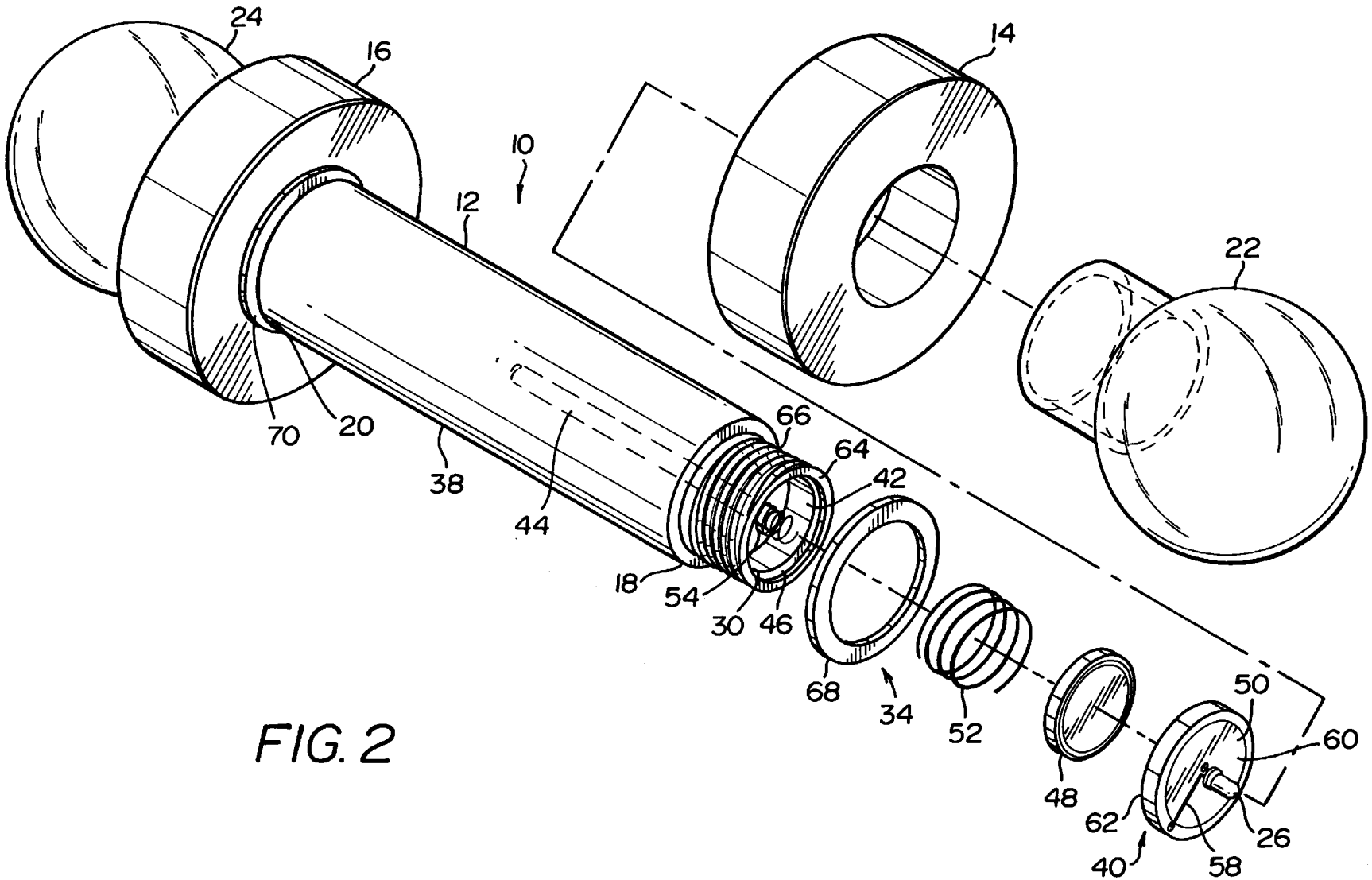
FIG. 2 is an exploded view of the present dumbbell.

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for teaching one skilled in the art how to make and/or use the invention.

With reference to FIGS. 1 through 8, the present dumbbell 10 is disclosed. The dumbbell 10 is a weighted exercise device including fluorescent lights along opposite ends of the dumbbell 10. As those of ordinary skill in the art will certainly appreciate, two dumbbells are commonly used at the same time, one in each hand, although a single dumbbell may be used if an individual so desires.

Briefly, the dumbbell 10 includes a central handle member 12 having first and second weight members 14, 16 selectively secured at opposite ends 18, 20 of the central handle member 12. First and second spherical lenses 22, 24 are also releasably coupled on opposite ends 18, 20 of the central handle member 12 at positions outside the first and second weight members 14, 16. In addition, first and second light emitting diodes (LEDs) 26, 28 are respectively secured at opposite ends 18, 20 of the central handle member 12 and positioned within the first and second spherical lenses 22, 24 to light the present dumbbell 10 in the manner discussed below.

The central handle member 12 is a weighted cylindrical steel member with first and second open ends 30, 32 adapted to respectively receive the first and second LEDs 26, 28, as well as switch elements 34, 36. The central handle member 12 is further provided with a rubber gripping surface 38. In addition to providing a comfortable gripping surface, the rubber gripping surface 38 provides insulation from the electrical current created by the present dumbbell 10. While the central handle member 12 is preferably made of steel, other conductive metals may be used without departing from the spirit of the present invention.

Figure 3:
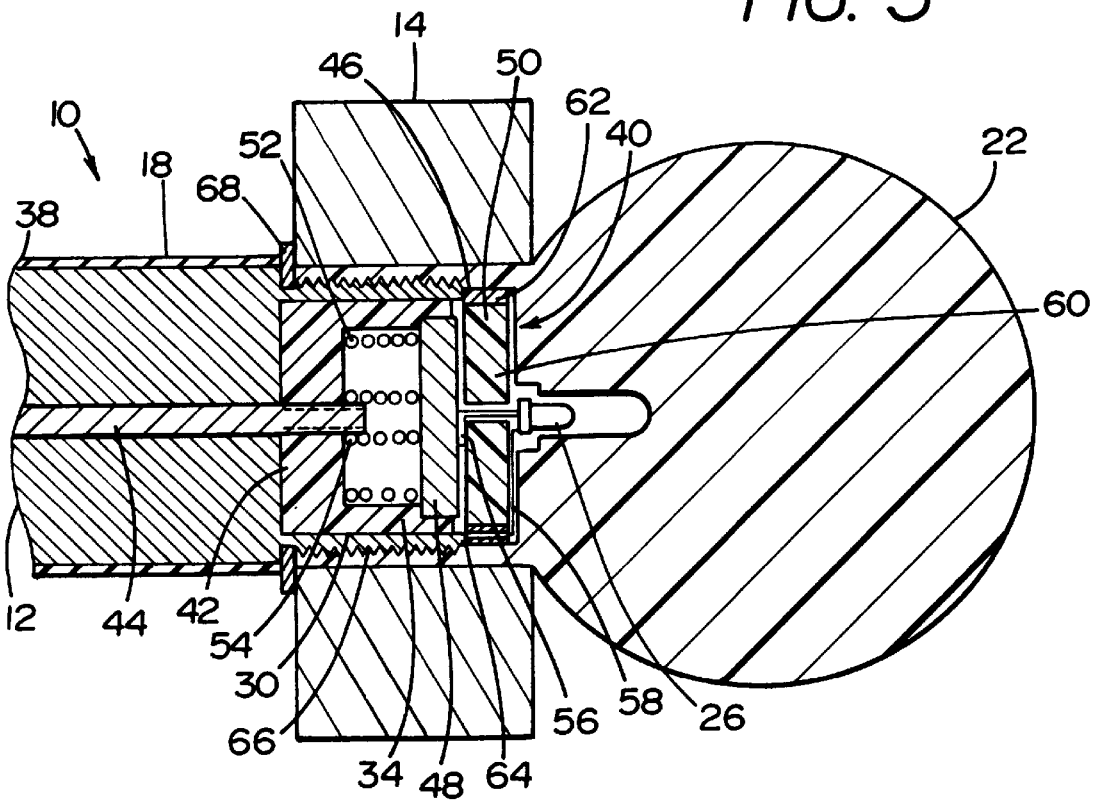
FIG. 3 is a cross sectional view of the present dumbbell with the electrical circuit completed.
Figure 4:
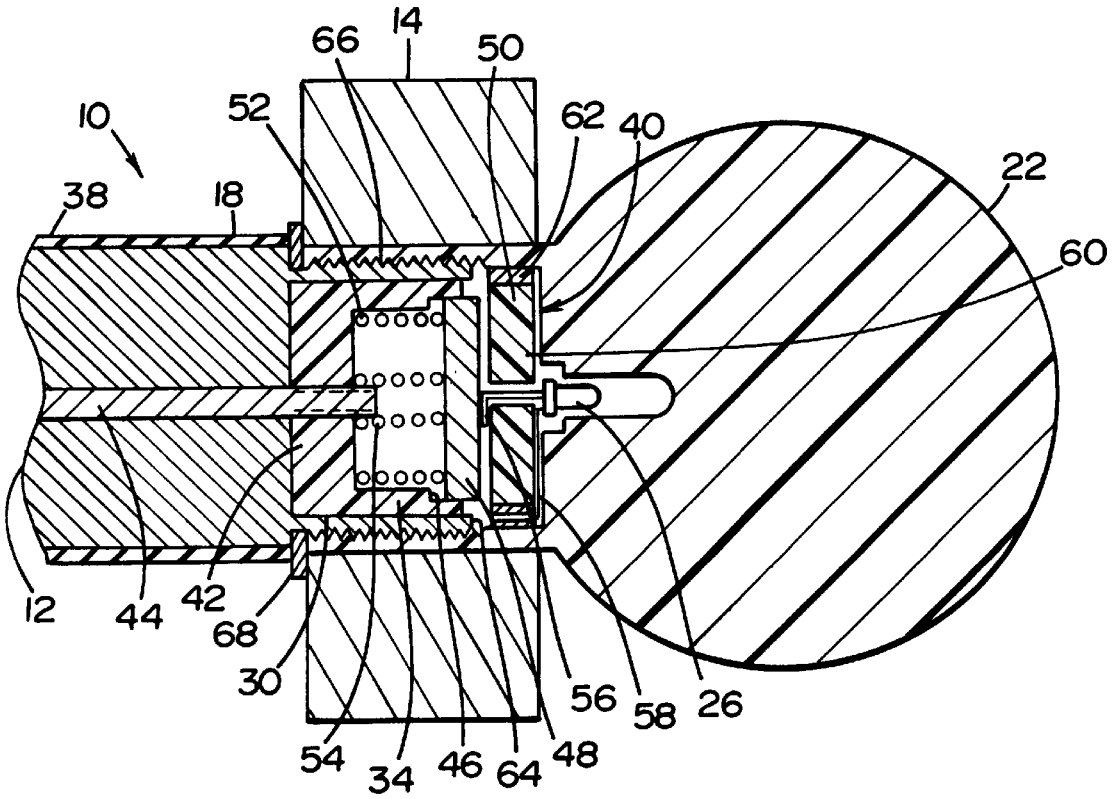
FIG. 4 is a cross sectional view of the present dumbbell with the electrical circuit opened.
Figure 5:
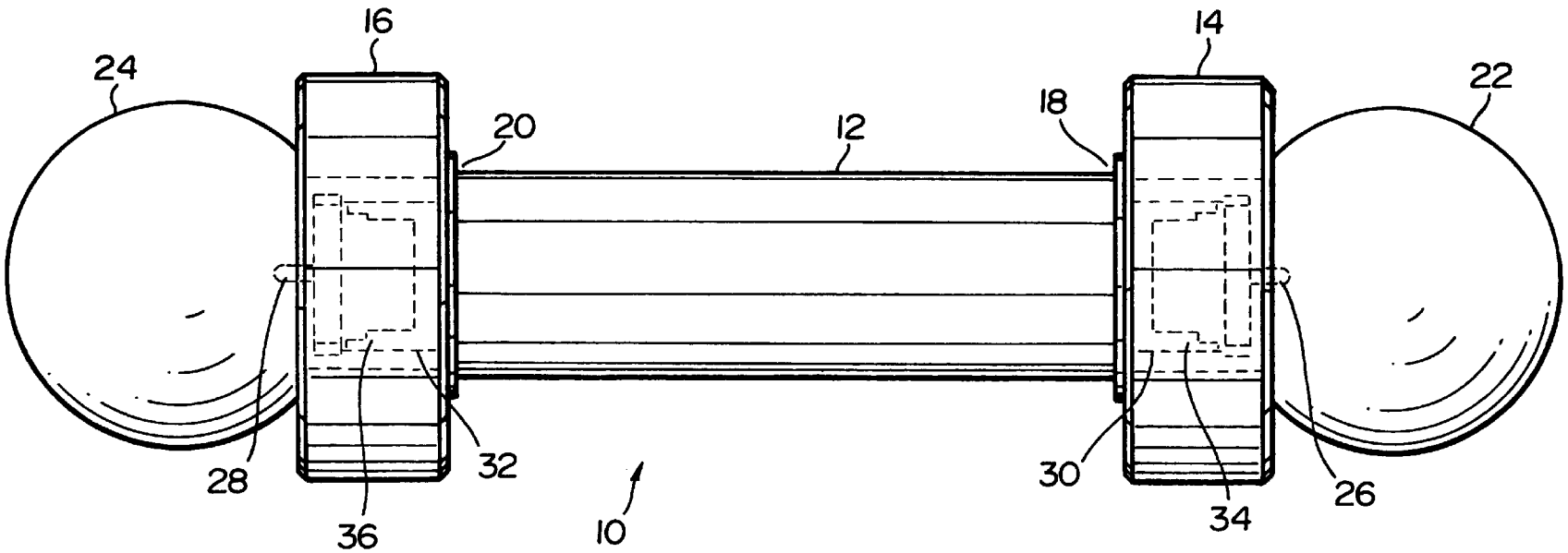
FIG. 5 is a side view with internal elements shown in phantom.
Figure 6:
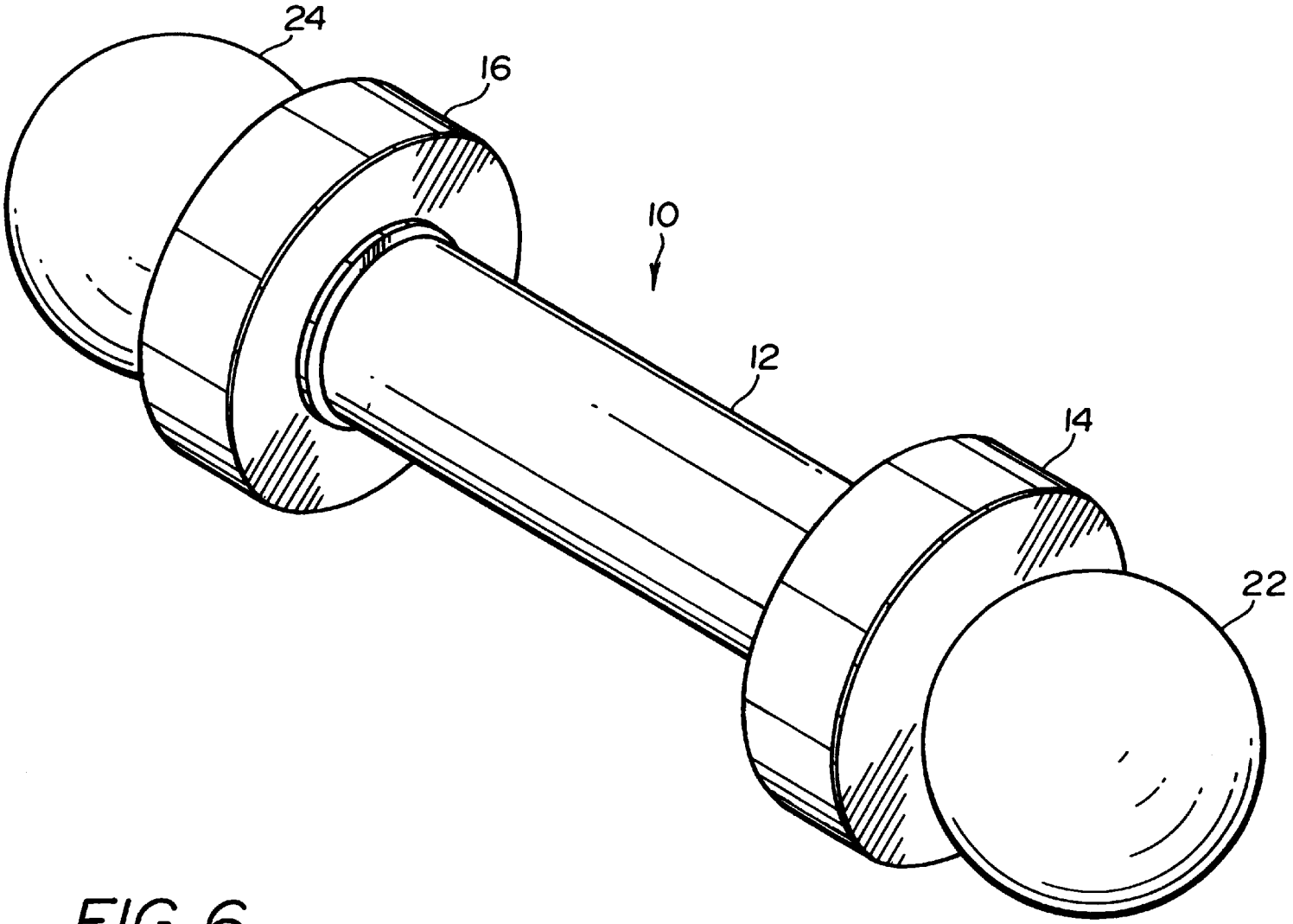
FIG. 6 is a perspective view of the present dumbbell.
Figure 7:
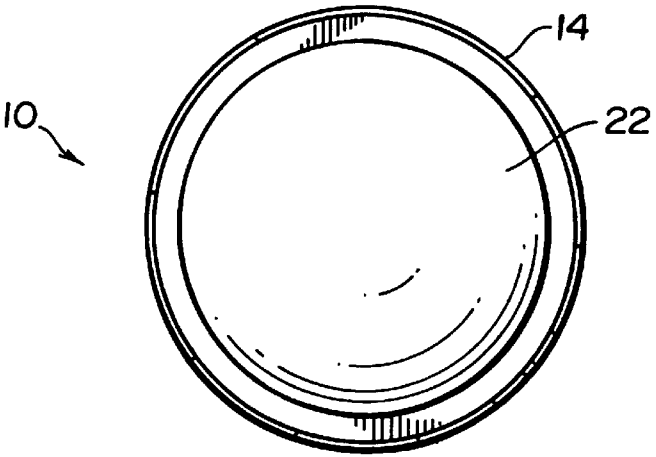
FIG. 7 is an end view of the present dumbbell.
Figure 8:
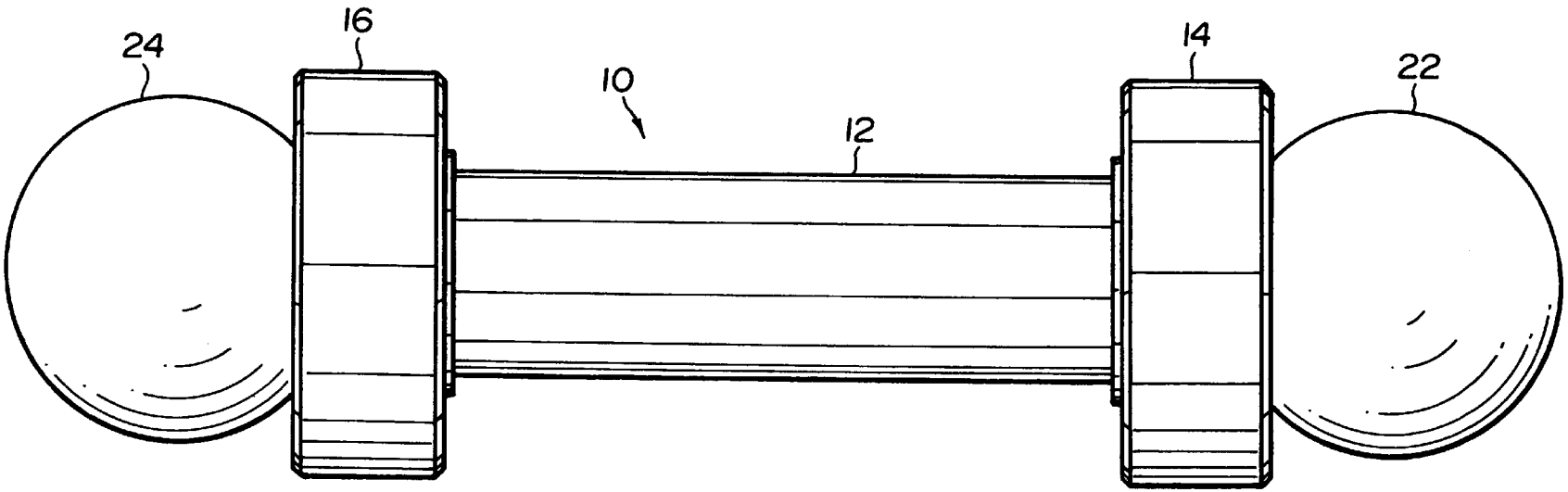
FIG. 8 is a side view of the present dumbbell.

Although FIGS. 3 and 4 only show the first open end 30 of the central handle member 12 and this end is described in detail below, it should be understood that the first and second open ends 30, 32 are substantially identical. The first open end 30 houses the first light assembly 40. The first light assembly 40 includes a conductive, metal first switch housing 42 positioned within the first open end 30 of the central handle member 12. The first switch housing 42 is substantially cup shaped and is rigidly held in position by a reinforcing bar 44 mounted within the first open end 30 of the central handle member 12. The first switch housing 42 includes a circular recess 46 along its inner circumference. The recess 46 is shaped to receive a first battery 48 which sits therein for reasons that are discussed below in greater detail. A first LED mounting plate 50 sits on top of the first battery 48 and the first spherical lens 22 holds the entire first light assembly 40 in position.

In use, first and second springs 52, 54 are positioned between the first switch housing 42 and the first battery 48. The spring 52 urges the first battery 48 toward a first electrical contact 56 of the first LED 26, which is mounted in the first LED mounting plate 50. The second electrical contact 58 of the first LED 26 extends across a nonconductive disc 60 of the first LED mounting plate 50 and contacts a conductive ring 62 secured about the nonconductive disc 60. As such, when the first LED mounting plate 50, and particularly the conductive ring 62, contacts the first distal end 64 of the central handle member 12, an electrical circuit is completed and the first LED 26 lights (see FIG. 3).

The central handle member 12 includes external threading 66 adjacent its first open end 30 on which the first spherical lens 22 is mounted. The first spherical lens 22 is secured on the central handle member 12 by rotating the first spherical lens 22 thereon, and holds the first light assembly 40 in position. Specifically, the first spherical lens 22 bears against the first LED mounting plate 50 and forces the conductive ring 62 into contact with the first distal end 64 of the central handle member 12. When this occurs a circuit passing through the first electrical contact 56 of the first LED 26, the first battery 48, the first switch housing 42, the central handle member 12, the conductive ring 62 and the second electrical contact 58 of the first LED 26 is completed (see FIG. 3). When the circuit is completed, the first LED 26 is illuminated. The circuit is, however, broken when the first spherical lens 22 is rotated slightly (see FIG. 4). This allows the spring 52 to push the first LED mounting plate 50 away from the first distal end 64 of the central handle member 12 and break the circuit. When the circuit is broken the first LED 26 goes off.

Additional weight may be added to the dumbbell by attaching weight members 14, 16 at the opposite ends of the central handle member 12. The first and second weight members 14, 16 are respectively secured between first and second enlarged annular rings 68, 70 and the enlarged portion of the first and second spherical lenses 22, 24. Specifically, the first and second enlarged annular rings 68, 70, respectively secured between the first and second spherical lenses 22, 24 and the central handle member 12, prevent the first and second weight members 14, 16 from sliding across the central handle member 12. The enlarged portions of the first and second spherical lenses 22, 24 respectively prevent the weight members 14, 16 from sliding off the central handle member 12. In this way, the weight members 14, 16 may be selectively removed from the dumbbell 10 to permit variation of the weight of the dumbbell. For example, the present dumbbell 10 may be used without the weight members 14, 16, relying only on the weight of the central handle member 12 and the spherical lenses 22, 24, or a variety of different sized weight members 14, 16 may be coupled to the dumbbell 10.

The first and second spherical lenses 22, 24 are fluorescent lenses and create a distinct glow when the LEDs 26, 28 are illuminated. The spherical lenses 22, 24 are preferably made from phosphorescent polycarbon plastic, although other fluorescing materials could be used without departing from the spirit of the present invention. As such, the lenses 22, 24 fluoresce with daylight or by the battery powered LEDs. When the present invention is used with long life lithium batteries one may expect to obtain a minimum of 20 hours of battery power before the batteries require replacement.

The light fluoresced by the lenses 22, 24 provides added visibility to those carrying the dumbbells. The added visibility is especially useful to those individuals using dumbbells as they walk or run along side a road.

While the preferred embodiment has been shown and described, it will be understood that there is no intent to limit the invention by such disclosure, but rather, is intended to cover all modifications and alternate constructions falling within the spirit and scope of the invention.

What is claimed is:

1. An exercise dumbbell, comprising:

a handle having a first weight member releasably coupled thereto; and a first light structure releasably coupled to the handle adjacent the first weight member such that the light structure securely couples the weight member to the handle.

2. The exercise dumbbell according to claim 1, wherein the handle includes a first end and a second end, and the first weight member and the first light structure are attached at the first end of the handle.

3. The exercise dumbbell according to claim 2, wherein the handle includes a first annular ring positioned adjacent the first end of the handle and the first weight member is releasably secured between the first annular ring and the first light structure.

4. The exercise dumbbell according to claim 3, wherein the first light structure includes a light source housed within a lens, and the first weight member is releasably secured between the first annular ring and the lens.

5. The exercise dumbbell according to claim 2, further including a second weight member and a second light structure respectively releasably coupled to the second end of the handle, wherein the second light structure securely couples the second weight member to the second end of the handle.

6. The exercise dumbbell according to claim 1, wherein the first light structure includes a light source housed within a lens.

7. The exercise dumbbell according to claim 6, wherein the light source is a light emitting diode.

8. The exercise dumbbell according to claim 6, wherein the lens is a fluorescent lens.

9. The exercise dumbbell according to claim 8, wherein the fluorescent lens is manufactured from phosphorescent polycarbon plastic.

10. The exercise dumbbell according to claim 1, further including a battery housed within the handle for powering the first light structure.

11. The exercise dumbbell according to claim 10, further including means for selectively powering the first light structure.

12. The exercise dumbbell according to claim 11, wherein the means for selectively powering includes spring biased electrical contacts which selectively complete the circuit between the battery and the first light structure.

* * * * *